US010633141B2

(12) United States Patent
Novotny et al.

(10) Patent No.: US 10,633,141 B2
(45) Date of Patent: Apr. 28, 2020

(54) PAPERBOARD CARTON

(71) Applicant: General Mills, Inc., Minneapolis, MN (US)

(72) Inventors: Peter Novotny, Crystal, MN (US); Jenna Melissa Ronquillo, Minneapolis, MN (US); George Tuszkiewicz, Plymouth, MN (US)

(73) Assignee: General Mills, Inc., Minneapolis, MN (US)

( * ) Notice: Subject to any disclaimer, the term of this patent is extended or adjusted under 35 U.S.C. 154(b) by 0 days.

(21) Appl. No.: 15/739,494

(22) PCT Filed: Jul. 24, 2015

(86) PCT No.: PCT/US2015/041970
§ 371 (c)(1),
(2) Date: Dec. 22, 2017

(87) PCT Pub. No.: WO2017/018988
PCT Pub. Date: Feb. 2, 2017

(65) Prior Publication Data

US 2018/0186503 A1 Jul. 5, 2018

(51) Int. Cl.
*B65D 5/32* (2006.01)
*B65D 5/44* (2006.01)
*B65D 5/00* (2006.01)

(52) U.S. Cl.
CPC ..... *B65D 5/32* (2013.01); *B65D 5/443* (2013.01); *B65D 5/001* (2013.01)

(58) Field of Classification Search
CPC ..... B65D 5/32; B65D 5/001
USPC ..... 229/122.21, 122.23, 940
See application file for complete search history.

(56) References Cited

U.S. PATENT DOCUMENTS 269,170 A 12/1882 Bragdon
380,364 A 4/1888 Surles
674,009 A * 5/1901 Lewis ..... B65D 5/566 229/122.33

(Continued)

FOREIGN PATENT DOCUMENTS

WO WO 1994/012328 6/1994

OTHER PUBLICATIONS

Grain Direction (Year: 2013).*

(Continued)

*Primary Examiner* — Nathan J Newhouse
*Assistant Examiner* — Nina K Attel
(74) *Attorney, Agent, or Firm* — Diederiks & Whitelaw, PLC; Gregory P. Kaihoi, Esq.

(57) ABSTRACT

A paperboard carton is formed by folding and interconnecting an even number of body pieces to establish at least a bottom wall, first and second spaced main face walls, opposing side walls and a top wall, which collectively define an interior cavity for containing edible products, with the first and second main face walls and the opposing side walls being spaced by each of the bottom wall and the top wall, each of said body pieces being formed of paperboard, and at least two of the body pieces having predominate fiber orientations which are directionally distinct from one another, thereby establishing a compression strength for each carton which enables similarly configured cartons to be directly stacked upon each other for shipping purposes.

17 Claims, 12 Drawing Sheets

(56) References Cited

U.S. PATENT DOCUMENTS

| | | | | | |
|---|---|---|---|---|---|
| 1,265,273 | A | | 5/1918 | Stokes et al. | |
| 1,512,157 | A | | 10/1924 | Bliss | |
| 1,514,367 | A | | 11/1924 | Bliss | |
| 1,895,778 | A | | 1/1933 | Andrews | |
| 2,149,955 | A | | 3/1939 | Burns | |
| 2,374,390 | A | | 4/1945 | Snyder | |
| 2,593,778 | A | | 4/1952 | McGinnis | |
| 2,606,709 | A | | 8/1952 | Carey et al. | |
| 2,609,138 | A | | 9/1952 | Weiss | |
| 2,701,679 | A | | 2/1955 | Goldstein | |
| 2,947,414 | A | * | 8/1960 | Johnson | B65D 5/12 206/320 |
| 3,007,622 | A | | 11/1961 | George | |
| 3,099,379 | A | | 7/1963 | Stease | |
| 3,217,924 | A | | 11/1965 | Chidsey, Jr. | |
| 3,237,838 | A | * | 3/1966 | Elias | B65D 5/326 229/104 |
| 3,291,370 | A | * | 12/1966 | Elias | B65D 5/0227 229/104 |
| 3,788,538 | A | | 1/1974 | Kuenzi | |
| 3,993,239 | A | | 11/1976 | Exel | |
| 4,040,559 | A | | 8/1977 | Giebel | |
| 4,211,358 | A | | 7/1980 | Crane | |
| 4,620,479 | A | | 11/1986 | Diamond et al. | |
| 4,655,386 | A | | 4/1987 | Billberg | |
| 4,871,063 | A | * | 10/1989 | Kumbier | B32B 1/00 206/386 |
| 4,884,739 | A | | 12/1989 | Nederveld | |
| 5,201,461 | A | | 4/1993 | Sykora | |
| 5,316,207 | A | | 5/1994 | Ross et al. | |
| 5,333,779 | A | * | 8/1994 | Sykora | B65D 5/326 229/122.21 |
| 5,390,847 | A | | 2/1995 | Young | |
| 5,419,485 | A | | 5/1995 | Petriekis et al. | |
| 5,497,939 | A | | 3/1996 | Heiskell et al. | |
| 5,639,015 | A | | 6/1997 | Petriekis et al. | |
| 5,839,650 | A | | 11/1998 | Sheffer | |
| 6,050,484 | A | | 4/2000 | Galomb | |
| 6,062,467 | A | | 5/2000 | Ours et al. | |
| 6,138,904 | A | | 10/2000 | Baird et al. | |
| 6,168,074 | B1 | | 1/2001 | Petriekis et al. | |
| 6,186,393 | B1 | | 2/2001 | Tsamourgelis | |
| 6,712,214 | B1 | | 3/2004 | Wintermute et al. | |
| 7,070,054 | B2 | | 7/2006 | Scrymgeour et al. | |
| 7,074,171 | B2 | | 7/2006 | Mahlum et al. | |
| 8,196,806 | B2 | | 6/2012 | Tao | |
| 8,695,870 | B2 | | 4/2014 | Etzel et al. | |
| 8,763,890 | B2 | | 7/2014 | Clark et al. | |
| 8,777,097 | B2 | | 7/2014 | Jacomelli et al. | |
| 8,875,983 | B2 | | 11/2014 | Lenhard et al. | |
| 2003/0038169 | A1 | | 2/2003 | Thibault | |
| 2006/0113364 | A1 | | 6/2006 | Bonner et al. | |
| 2007/0152029 | A1 | | 7/2007 | Gardner | |
| 2013/0020383 | A1 | | 1/2013 | Tautz et al. | |
| 2014/0013716 | A1 | * | 1/2014 | Mallard | B65D 37/00 53/467 |

OTHER PUBLICATIONS

Urbanik, "*Machine Direction Strength Theory of Corrugated Fiberboard*", Journal of Composites Technology & Research, JCTRER, vol. 18, No. 2, Apr. 1996, pp. 80-88.

* cited by examiner

PAPERBOARD CARTON

CROSS-REFERENCE TO RELATED APPLICATIONS

This application represents a National Stage application of PCT/US2015/041970, filed Jul. 24, 2015, and titled "Paperboard Carton", the entire contents of which is incorporated herein by reference.

FIELD OF THE INVENTION

The invention generally pertains to packaging products, such as food products, in cartons and, more specifically, to a paperboard carton made from multiple, separate pieces having structural characteristics which vary in fiber orientation, basis weight and/or overall material.

BACKGROUND OF THE INVENTION

In connection with shipping various types of products, such as food products, from a manufacturer to a retail establishment, it is known to initially package the products in cartons. Although various materials could be used in making the cartons, the most common material employed is paperboard. In general, the paperboard is provided in the form of a blank which can be conveniently stored in a flat configuration or side seamed configuration but easily erected through a simple folding operation to establish an open-ended carton which can be filled and sealed, typically in an automated process. Multiple cartons are then typically arranged side-by-side in a corrugated box for shipping through designated distribution channels to the retail establishment, such as a grocery store, where the cartons in each shipping box can be unloaded and arranged on a display shelf for sale to consumers.

Known end load cartons of this type are not only lightweight, but the paperboard is advantageously recyclable. However, such paperboard cartons lack significant compression strength, leading to the need for the cartons to be loaded side-by-side in the protective, outer corrugated shipping boxes. If additional strength is needed for shipping purposes, common sense would dictate strengthening a single corrugated box which can hold numerous paperboard cartons rather than incurring the added expense of reinforcing each paperboard carton. With this in mind, certain advancements have been made in the area of corrugated boxes to enable numerous loaded boxes to be stacked on one another, while avoiding crushing of the boxes and stacking forces from being borne by the cartons. For example, enhanced lamination configurations, fluting techniques and material variations represent certain approaches commonly considered in the industry.

It would certainly be beneficial and cost effective to also minimize the amount of corrugated fiber needed in the industry. This could be addressed by enabling paperboard cartons to be stacked and to directly bear some or all of the associated vertical forces. To this end, it is considered advantageous to enable various products, such as food products, to be packaged in paperboard cartons which themselves are strengthened to enable vertical stacking. Even further, it would be unprecedented if the paperboard cartons could even be shipped in a stacked configuration without the need for an outer container, such as a corrugated box. Certainly, this goal is achievable, but has not been considered practical, particularly as the added cost of bolstering the strength of the cartons, taking into account the sheer volume of such paperboard cartons used in the food industry alone, would be prohibitive. Still, in light of the known drawbacks, it would be desirable to provide paperboard cartons which are stronger so as to enhance their ability to be stacked if the same could be economically accomplished.

SUMMARY OF THE INVENTION

The invention is directed to forming a paperboard carton from multiple, separate pieces, with the pieces varying in at least one of fiber orientation, basis weight and material construction. In accordance with the invention, carton strength is increased, while the amount of fiber utilized, as compared to a conventional carton, is held constant or reduced.

More specifically, a carton constructed in accordance with the invention is formed from an even number of body pieces which are folded and interconnected to establish at least a bottom wall, first and second spaced main side or face walls, opposing side walls and a top wall which collectively define an interior cavity for containing a product to be sold to a consumer. In one preferred embodiment, the entire carton is formed from four interconnected body pieces, including two main face walls or panels and two side walls, with the two side walls being identically constructed and, except for portions of the main face walls which are folded to form the top wall, the main face walls are also identically constructed. In another preferred embodiment, the entire carton is formed from two interconnected body pieces which, similar to the four body piece embodiment, have correspondingly shaped face and side wall portions. In each embodiment, the body pieces are formed of paperboard and a fiber orientation between various wall portions are established to be directionally different. Optionally, a caliper of the various wall portions can be varied. Overall, the carton exhibits enhanced compression strength which enables similarly configured ones of the cartons to be directly stacked for shipping purposes.

Additional objects, features and advantages of the invention will become more readily apparent from the following detailed description when taken in conjunction with the drawings wherein like reference numerals refer to corresponding parts in the several views.

DETAILED DESCRIPTION OF EMBODIMENTS

Figure 1:
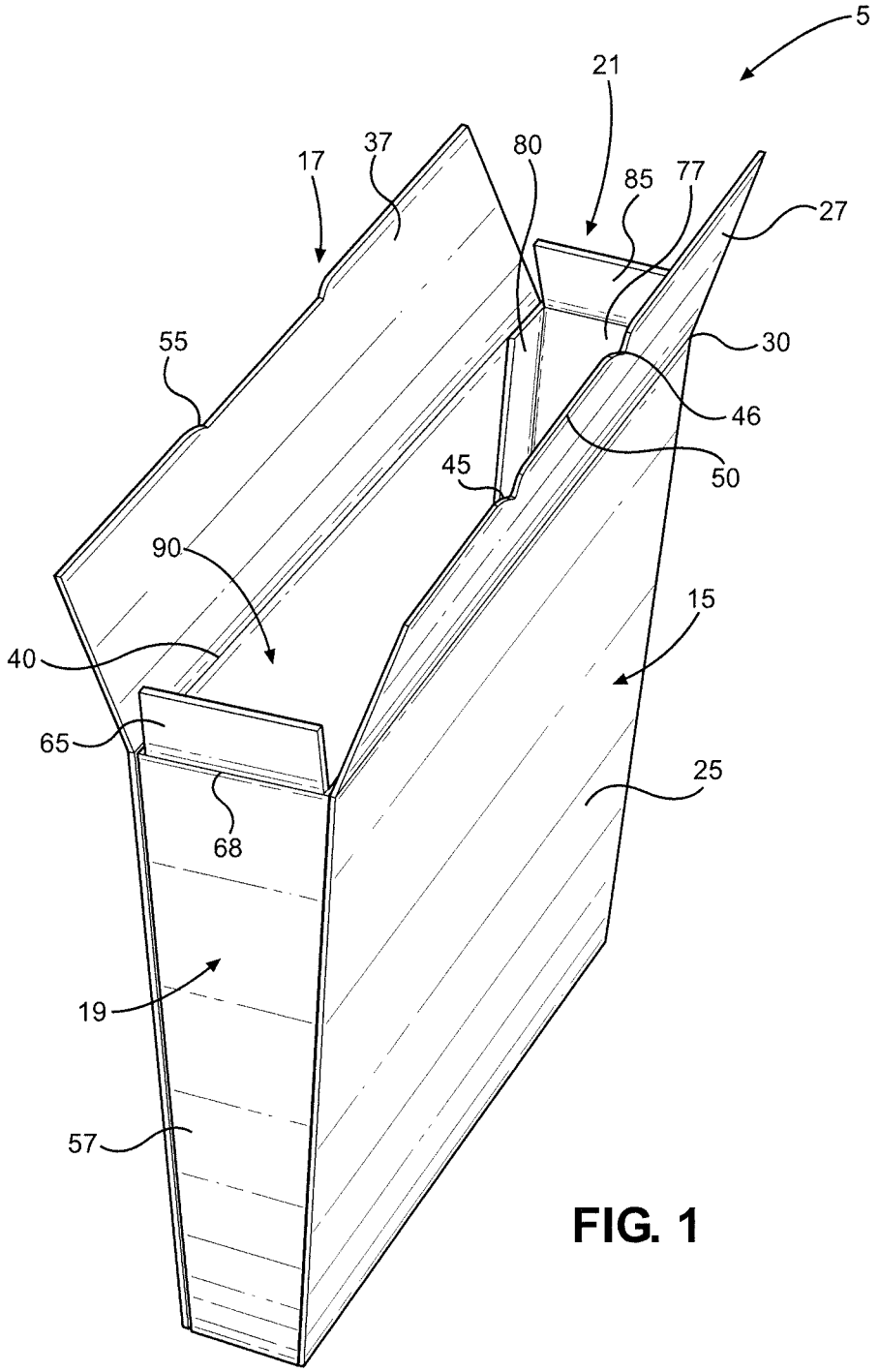
FIG. 1 is a perspective view of an upper portion of an open ended paperboard carton constructed of four main body pieces in accordance with an embodiment of the invention.

Detailed embodiments of the present invention are disclosed herein. In connection with this description, it should be noted that the use of certain terms, such as upper, lower, inner, outer, front, rear, top, bottom and the like, herein is for reference purposes only in describing exemplary forms of the invention as set forth below and illustrated in the drawings. Therefore, these terms should not be considered limiting as to the overall invention. Instead, it is to be understood that the disclosed embodiments are merely exemplary of the invention that may be embodied in various and alternative forms. The figures are not necessarily to scale, and some features may be exaggerated or minimized to show details of particular features or components.

In general, described below is the construction of cartons formed from paperboard blanks in accordance with the invention. It will be recognized that each embodiment is concerned with establishing a carton from an even number of body pieces which are folded and interconnected to form the carton. In accordance with a particular aspect of the invention, the different body pieces vary in construction, particularly with respect to a caliper and/or a fiber orientation between various wall portions established by the individual body pieces. Based on the overall construction, the cartons have been demonstrated to exhibit enhanced compression strength which enables similarly configured ones of the cartons to be directly stacked for shipping purposes.

Figure 2:
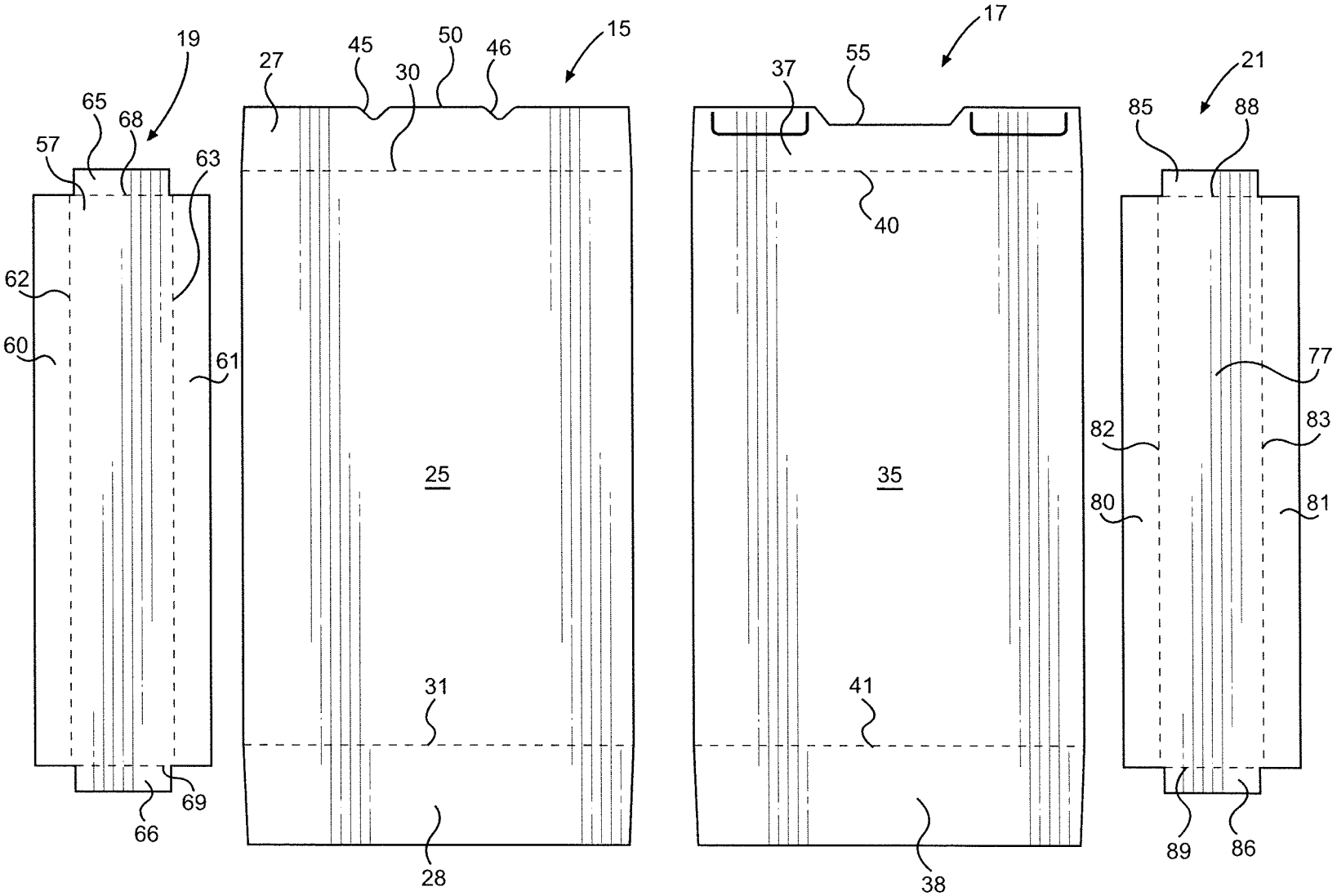
FIG. 2 is a plan view of a paperboard blank assembly from which the carton of FIG. 1 is erected.

With initial reference to FIGS. 1 and 2, an open ended carton constructed in accordance with the present invention is generally indicated at 5. In accordance with this preferred embodiment, carton 5 is formed by folding and interconnecting four body pieces, including a first main body piece 15, a second main body piece 17, a first side piece 19 and a second side piece 21. More specifically, first main body piece 15 includes a first main side or face wall 25, an upper flap 27 and a lower flap 28, with upper and lower flaps 27 and 28 being joined to first main side wall 25 along fold lines 30 and 31 respectively. In a similar manner, second main body piece 17 includes a second main side or face wall 35, an upper flap 37 and a lower flap 38, with upper and lower flaps 37 and 38 being joined to second main side wall 35 along fold lines 40 and 41 respectively. Overall, each of first and second main body pieces 15 and 17 are shown to be substantially rectangular in shape, aside from the slight tapering of lower flaps 28 and 38, the inclusion of spaced notches 45 and 46 forming a central tab 50 in upper flap 27, and the provision for a central recess 55 in upper flap 37.

As shown best in FIG. 2, first side piece 19 includes a side wall 57 from which extend, at spaced locations, elongated legs 60 and 61 along fold lines 62 and 63 respectively, as well as short legs 65 and 66 along fold lines 68 and 69. In the embodiment shown, second side piece 21 is symmetrically constructed to first side piece 19 and therefore includes a side wall 77, elongated legs 80 and 81, fold lines 82 and 83, short legs 85 and 86, and fold lines 88 and 89.

Figure 3:
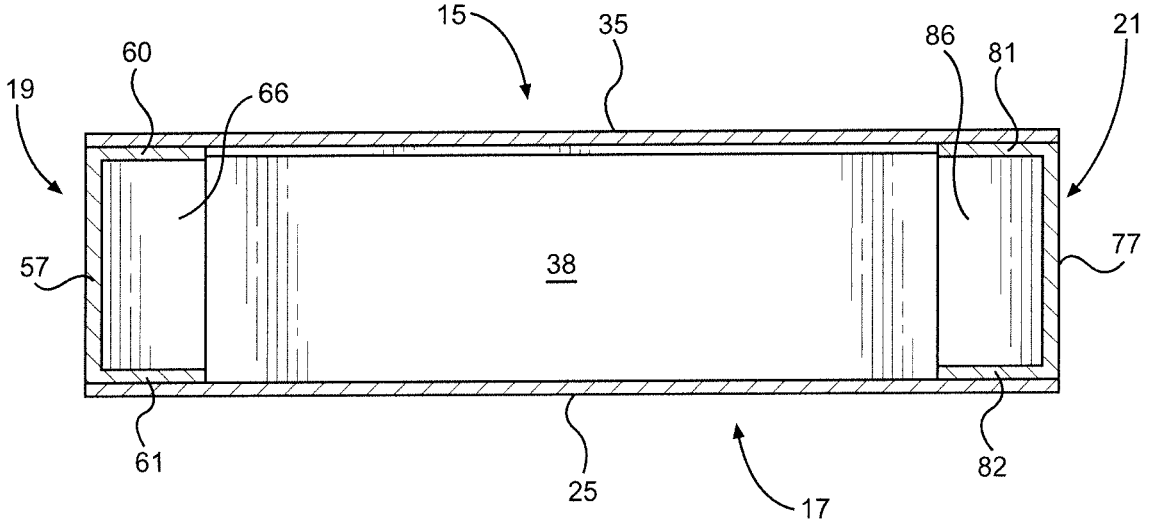
FIG. 3 is top cross-sectional view of the carton of FIG. 1.

In assembling or erecting carton 5 to the condition presented in FIGS. 1 and 3, elongated legs 61 and 81 are folded along lines 63 and 83 and then attached, such a through the use of an adhesive and/or other bonding materials and methods, along first main side wall 25, while elongated legs 60 and 80 are similarly folded along lines 62 and 82 and then attached to second main side wall 27. Short legs 66 and 86 are folded toward each other along lines 69 and 89 respectively, followed by lower flap 38 along line 41. Thereafter, lower flap 28 is folded along line 31 and adhered or otherwise secured to lower flap 38. At this point it should be recognized that, at least in this embodiment shown, first and second main side walls 25 and 35 are the largest of the side walls of carton 5 in area, i.e., each side wall 25, 35 establishes a face for carton 5 having an associated area which is generally in the order of at least three times the surface area of either of opposing side walls 57 and 77. For the particular type of carton shown, each of the side walls 57, 77 is also greater in area than a bottom wall established essentially by overlapping lower flaps 28 and 38. By way of example, side wall 25 can constitute the front face of a cereal or other carton and can be provided with suitable indicia reflecting the name, brand and the like of product contained within an interior cavity 90 (see FIG. 1) defined within carton 5 for products to be sold to a consumer, such as edible food products.

With this arrangement, much like a conventional food carton which is formed by folding a single blank such that there exist a pair of closure flaps to establish both the top and bottom walls of the carton, carton 5 has an overlapping bottom wall. In a manner also directly corresponding with known cartons of this type, the top of carton 5 can be selectively closed, after being initially opened, by slipping tab 50 of upper flap 27 under lower flap 37 in the region of central recess 55. However, unlike conventional food cartons, body pieces 15, 17, 19 and 21 can be formed differently. For instance, body pieces 19 and 21 can be constructed different from body pieces 15 and 17. More specifically, in accordance with preferred aspects of the invention, carton 5 is made of paperboard and formed from an even number of separate body pieces (15, 17, 19 and 21 in this embodiment), with the pieces varying in at least one of basis weight, fiber orientation and material construction to provide carton 5 with increased strength but with a reduction in the amount of fiber utilized, as compared to a conventional carton, as will be detailed fully below.

As indicated above, it is an object of the invention to structure carton 5 to be able to withstand significant vertical loading without being crushed or buckling, thereby enabling multiple cartons 5 to be vertically stacked and withstand certain vertical loads exerted thereon, even when shipped. Initially, it should be recognized that the vertical load capability of carton 5 is enhanced to a certain degree in accordance with the invention as compared to a conventional carton based on the inclusion of legs 60, 61, 80 and 81, along with the associated bonding material, at the vertical corners of carton 5. Therefore, the multi-piece construction of carton 5 contributes to the goals of the invention. However, in accordance with the invention, other structural parameters are also altered to enable the objects of the invention to be achieved. In particular, the basis weight or caliper of the paperboard material of body pieces 19 and 21 is made greater than the caliper of body pieces 15 and 17. This aspect of the invention can be achieved by reducing the basis weight of body pieces 15 and 17, increasing the basis weight of body pieces 19 and 21, or both. In accordance with another aspect of the invention, the fiber orientation of body pieces 19 and 21, in particular side walls 57 and 77, are different than body pieces 15 and 17, particularly main side walls 25 and 35. Most preferably, the paperboard fibers of main side walls 25 and 35 are arranged to run predominantly horizontally (i.e., directionally between opposing side walls 57 and 77), while the fibers of opposing side walls 57 and 77 predominantly run vertically (i.e., directionally between the top and bottom walls). Obviously, paperboard will generally have mixed fiber orientations. However, in accordance with this aspect of the invention, the overall majority of the fiber orientation is controlled. For instance, for side walls 57 and 77, a 5:2 ratio of vertical to horizontal fibers, i.e., predominantly vertical versus predominantly horizontal, can be employed such that at least 70% of the fibers are mainly orientated in the desired direction. In accordance with a still further aspect of the invention, although the entire carton 5 is formed of paperboard, mixed types of materials can be employed, such as non-recycled material for body pieces 19 and 21 versus recycled materials for body pieces 15 and 17, in general a variation in material composition, such as different grades of board. Overall, the top-to-bottom and side-to-side compression strength can be enhanced by increasing the amount of basis weight of fiber in the areas of the greatest mechanical stresses. In addition, the use of an even number of body pieces assures symmetry in construction and strength.

Figure 4:
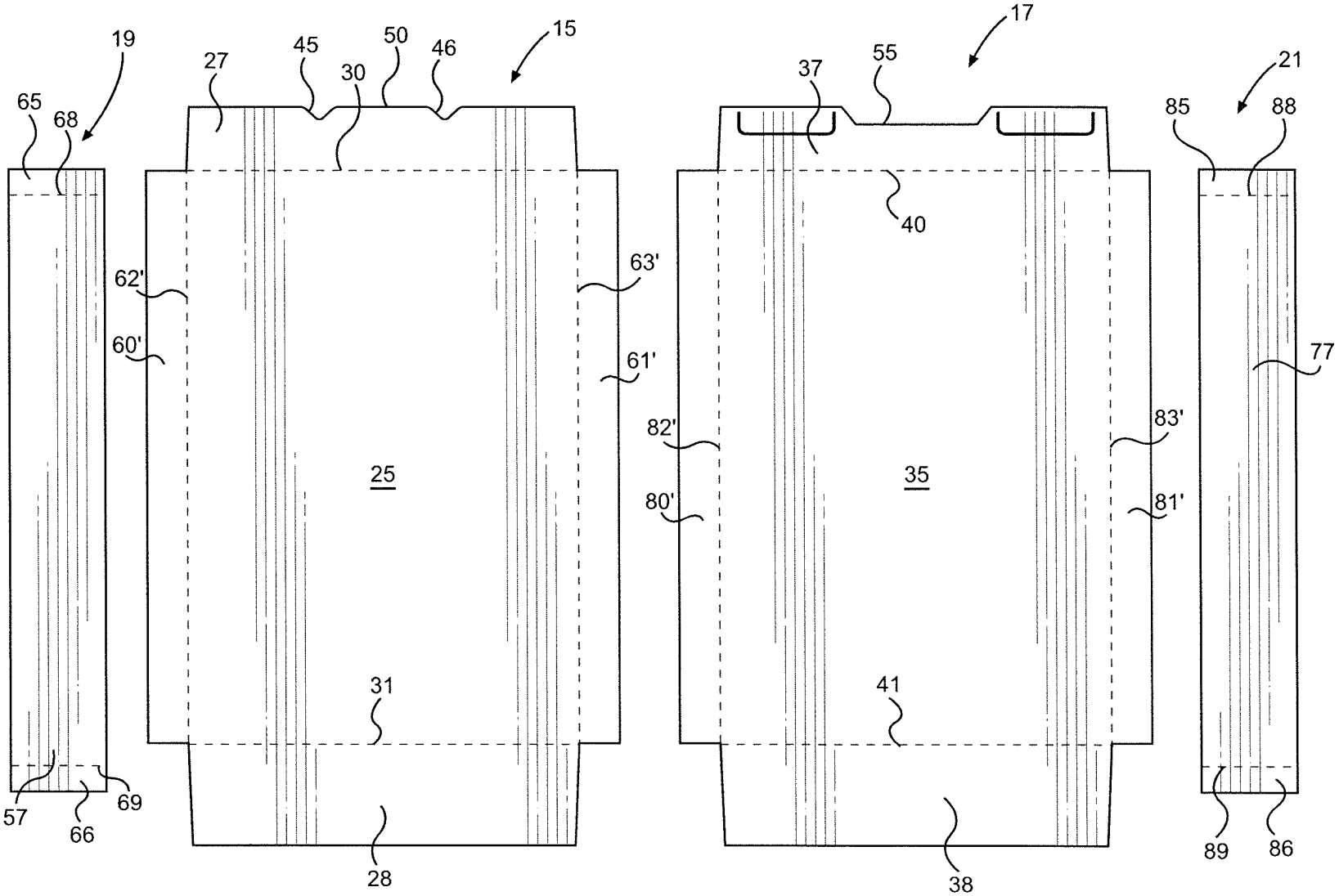
FIG. 4 is a plan view illustrating a variant of the blank assembly of FIG. 2.
Figure 5:
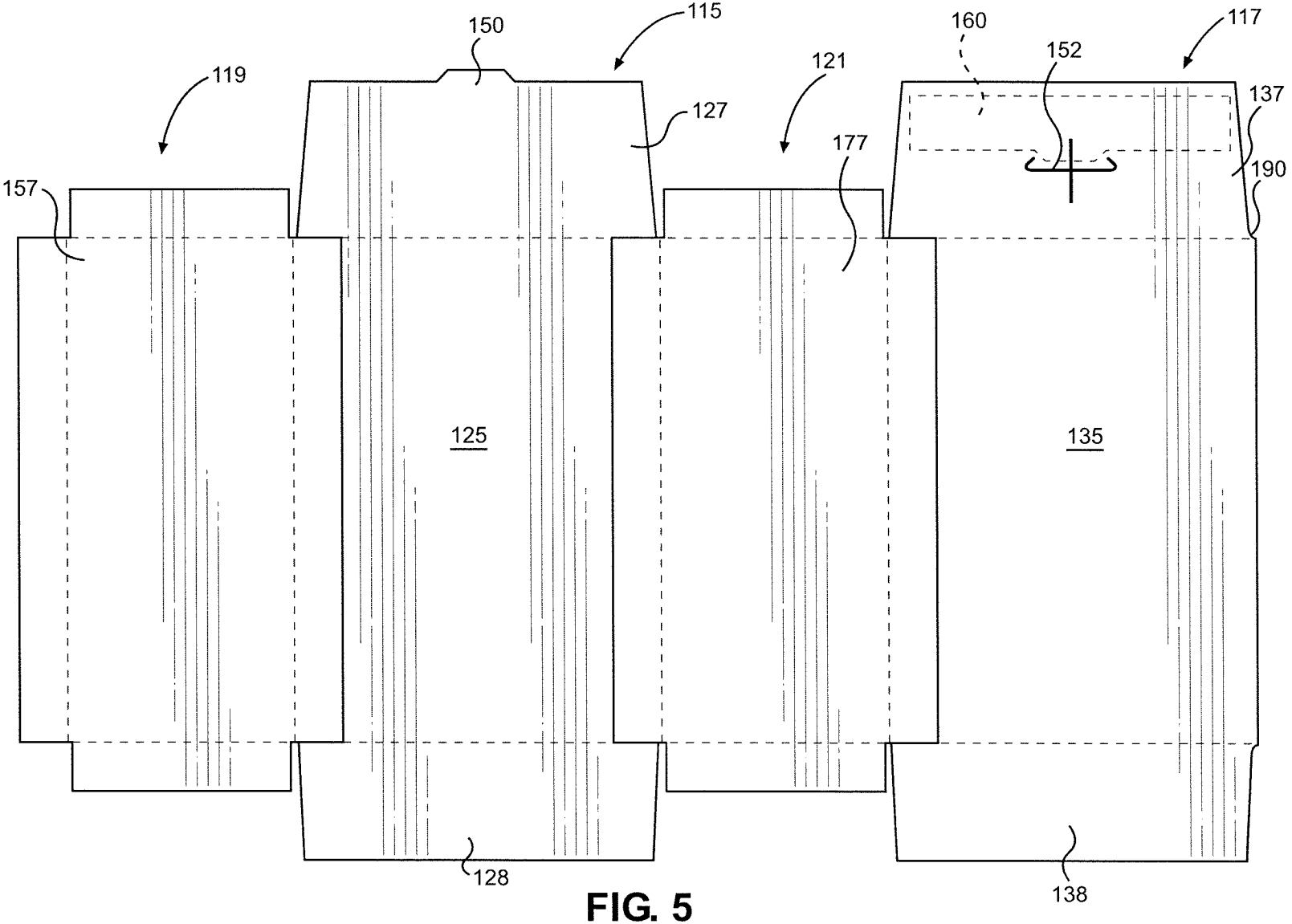
FIG. 5 is a plan view illustrating another variant of the blank assembly of FIG. 2 partially interconnected.
Figure 6:
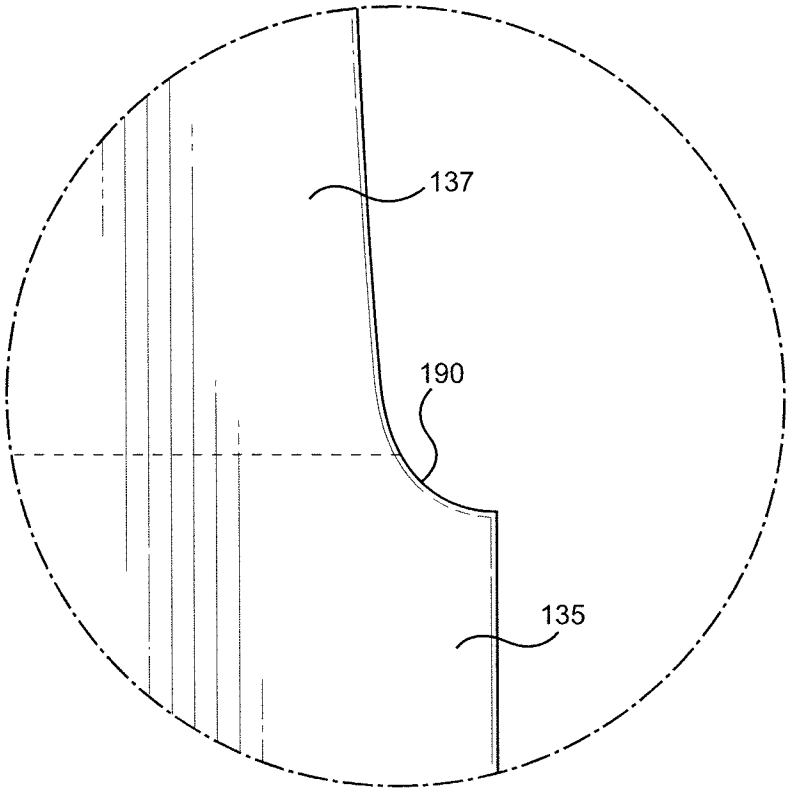
FIG. 6 is an enlarged view of a radiused portion of the blank assembly of FIG. 5.

Prior to discussing additional details and advantages of the invention, it should be recognized that the various body pieces can be varied in construction, size and shape while still exhibiting the desired attributes. To this end, FIG. 4 shows a variant of FIG. 2 basically wherein legs 60 and 61 are no longer on side wall 57 but rather corresponding, interconnecting legs 60' and 61' have associated fold lines 62' and 63' with side wall (front face) 25. Similarly, legs 80 and 81 of FIG. 2 have been replaced by legs 80' and 81' which extend from side wall (rear face) 35 along fold lines 82' and 83' respectively. FIG. 5 shows an embodiment wherein four body pieces 115, 117, 119 and 121 are folded and interconnected in a manner generally corresponding to that discussed above but which forms a differently shaped carton. Here, in particular, the analogous opposing side walls 157 and 177 are greater in size that the embodiment of FIGS. 1-3, the analogous upper flap 127 includes a central, projecting tab 150 and the upper flap 137 of the second body piece 117 is provided with a cut line 152 for receiving tab 150 for carton reclosure purposes. In addition, an embossed or glued reinforcing pad 160 is provided on an underside (not separately labeled) of upper flap 137 and extends substantially to cut line 152. Furthermore, it will be noted that body pieces 115 and 117 are not actually rectangular in shape, with the upper and lower flaps 127, 128 and 137, 138 extending at an angle from main side walls 125 and 135 respectively, so that the flaps 127, 128, 137 and 138 actually taper away from a respective wall 125, 135. Finally, the associated corners between these body portions can be radiused, such as shown at 190 in FIGS. 5 and 6, and/or other shape variations.

Figure 7:
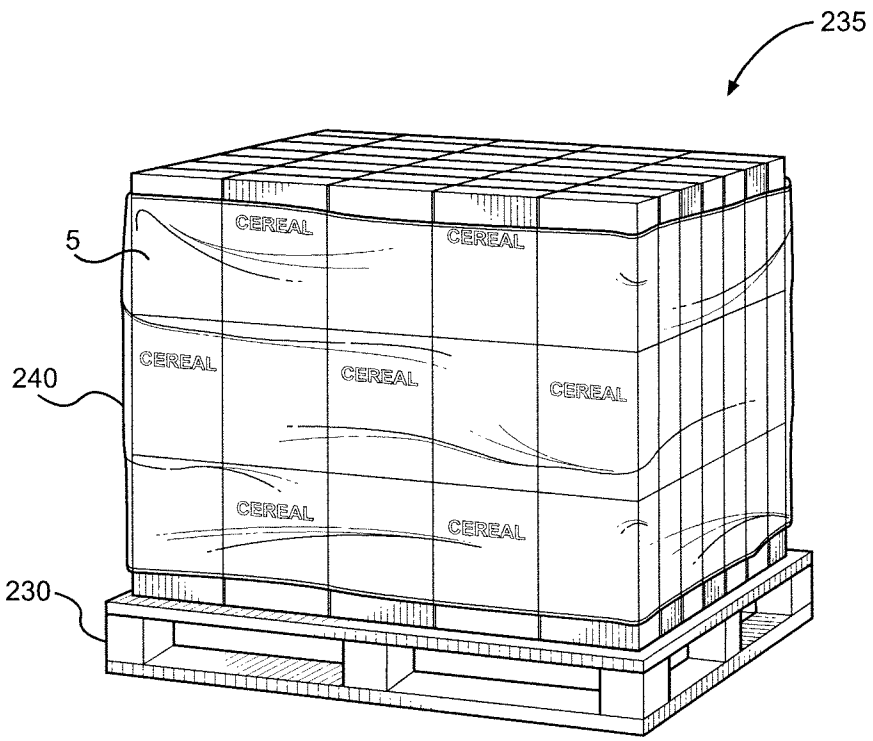
FIG. 7 is a perspective view of an array of the cartons of FIG. 1 assembled on a pallet for shipping.
Figure 8:
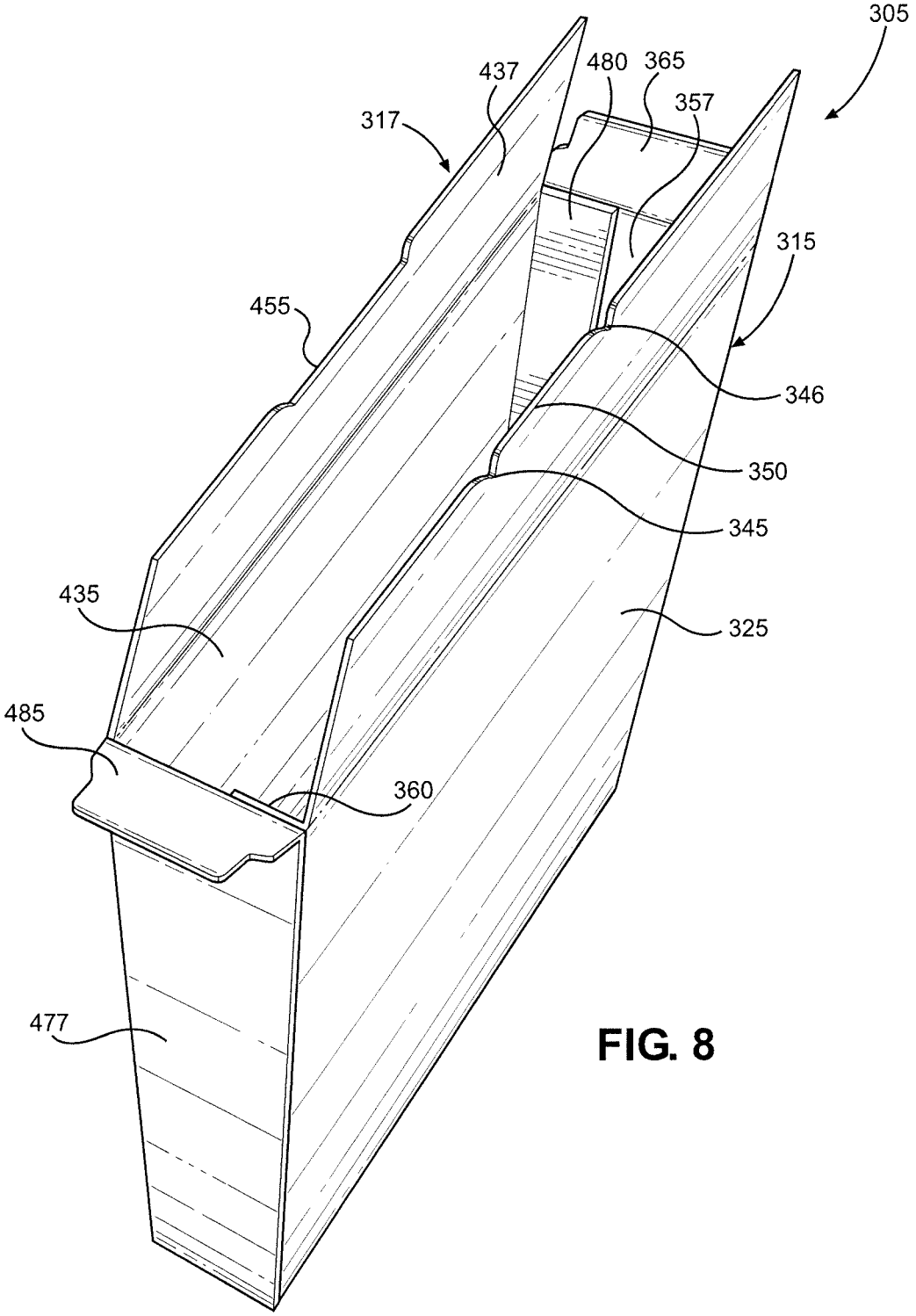
FIG. 8 is a perspective view of an upper portion of an open ended paperboard carton constructed of two main body pieces in accordance with another embodiment of the invention.
Figure 9:
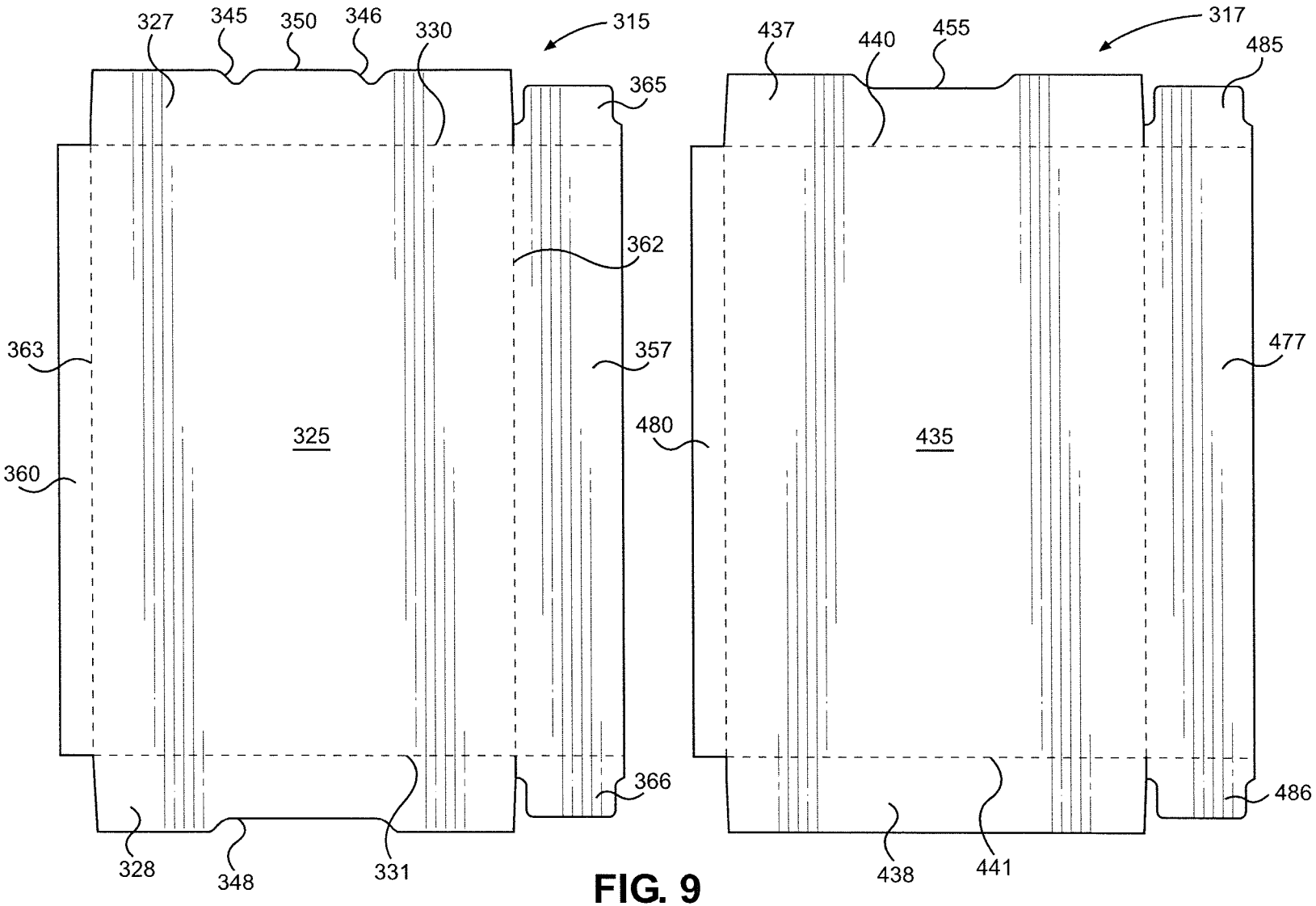
FIG. 9 is a plan view of a paperboard blank assembly from which the carton of FIG. 8 is erected.
Figure 10:
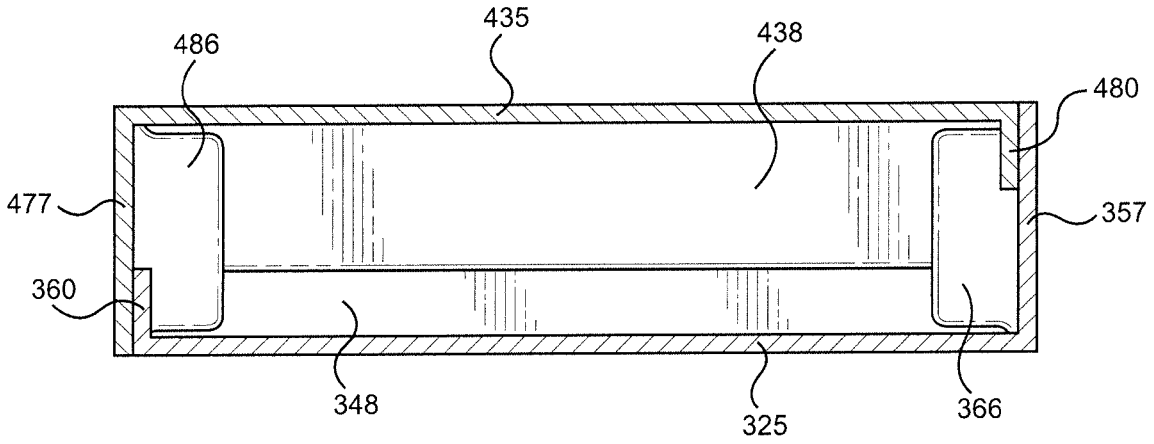
FIG. 10 is top cross-sectional view of the carton of FIG. 8.

Regardless of these potential variations, the caliper, materials and/or fiber orientation variations discussed above can be equally employed. Still, there is seen to exist particular advantages in employing the invention in connection with cartons having aspect ratios of bottom wall to either opposing small side wall, e.g. side walls 57 and 77 or 157 and 177, which are less than one. That is, although the strength improvement achieved in accordance with the invention can be considered independent of aspect ratio, cartons or boxes including bottoms having associated areas greater than the relative sides tend to be stronger and therefore may not benefit as much from the invention, at least as compared to cartons which have a relatively small base in combination with fairly large upstanding walls. In any case, the compression strengths associated with the cartons or boxes constructed in accordance with the invention are significantly greater than the compression strength of a conventional carton, even when the basis weight of the cartons made in accordance with the invention is held constant or reduced. Therefore, the cartons of the invention can withstand increased vertical loading, but the same can be achieved with fiber reductions and, correspondingly, savings in material costs. For instance, it has been found that a carton can be created in accordance with the invention from 14 point paperboard to replace a current style carton made from 22 point paperboard, while still achieving about a 40% increase in strength. This significant change has an abundance of ramifications. For instance, it is possible to avoid the need for additional corrugated shipping boxes. Instead, as represented in FIG. 7, it is possible to load a pallet 230 with an exposed array 235 of stacked cartons constructed in accordance with the invention and employ shrink wrap 240, bands or the like to contain the directly exposed array 235 for shipping purposes. In addition, in practicing the invention it should be noted that known paper mill production techniques do not need to be altered to carry out the invention. That is, the components of the cartons of the invention can be made from standard paperboard stock, while just significantly reducing the caliper and/or fiber content and orientation of the paperboard yet still enhancing the compression strength. Still, this process can be readily automated, such as at a food packaging plant, without affecting the paper mill operation.

As indicated above, a feature of the present invention is to form each carton from an even number of body pieces. This arrangement assures the symmetry in strength and construction desired. Embodiments of four and two body pieces are preferred. For the sake of completeness, FIGS. 8-12 illustrate exemplary two body piece embodiments of the invention. With initial reference to FIGS. 8-10, a carton 305 is formed from just first and second body pieces 315 and 317. As shown, first body piece 315 establishes both a first main side wall 325, with upper and lower flaps 327 and 328 attached along fold lines 330 and 331. As also depicted, upper flap 327 is provided with notches 345 and 346 which establish a tab 350. In addition, lower flap 328 is provided with a recess 348. In particular with this embodiment, it will be noted that body piece 315 also incorporates an integral side wall 357 and opposing elongated leg 360. That is, side wall 357 is attached along a fold line 362 and elongated leg 360 is attached along a fold line 363 at opposing edge portions (not separately labeled) of main side wall 325. Finally, side wall 357 has contoured upper and lower short legs 365 and 366.

In a generally similar fashion, second body piece 317 establishes both a second main side wall 435, with upper and lower flaps 437 and 438 attached along fold lines 440 and 441 respectively. In a manner similar to the embodiment of FIG. 2, upper flap 437 includes a recess 455 adapted to cooperate with tab 350 in reclosing carton 305. Otherwise, second body piece 317 is generally construction in a manner corresponding to first body piece 315 with respect to the inclusion of a foldable side wall 477, a foldable elongated support leg 480 and foldable upper and lower short legs 485 and 486. In any case, with this embodiment, the main difference is the integration of side wall 357 and elongated leg 360 with side wall 325, and side wall 477 and elongated leg 480 with side wall 435. In addition, in this embodiment, variations in the caliper, materials and/or fiber orientation exists between the first and second body pieces 315 and 317. Still, with the varying vertical and horizontal fiber orientation, potentially in combination with the caliper variation and differences in materials employed, there are still cost savings in forming carton 305 versus a conventional carton, yet carton 305 has greater compression strength so as to enable direct stacking.

Figure 11:
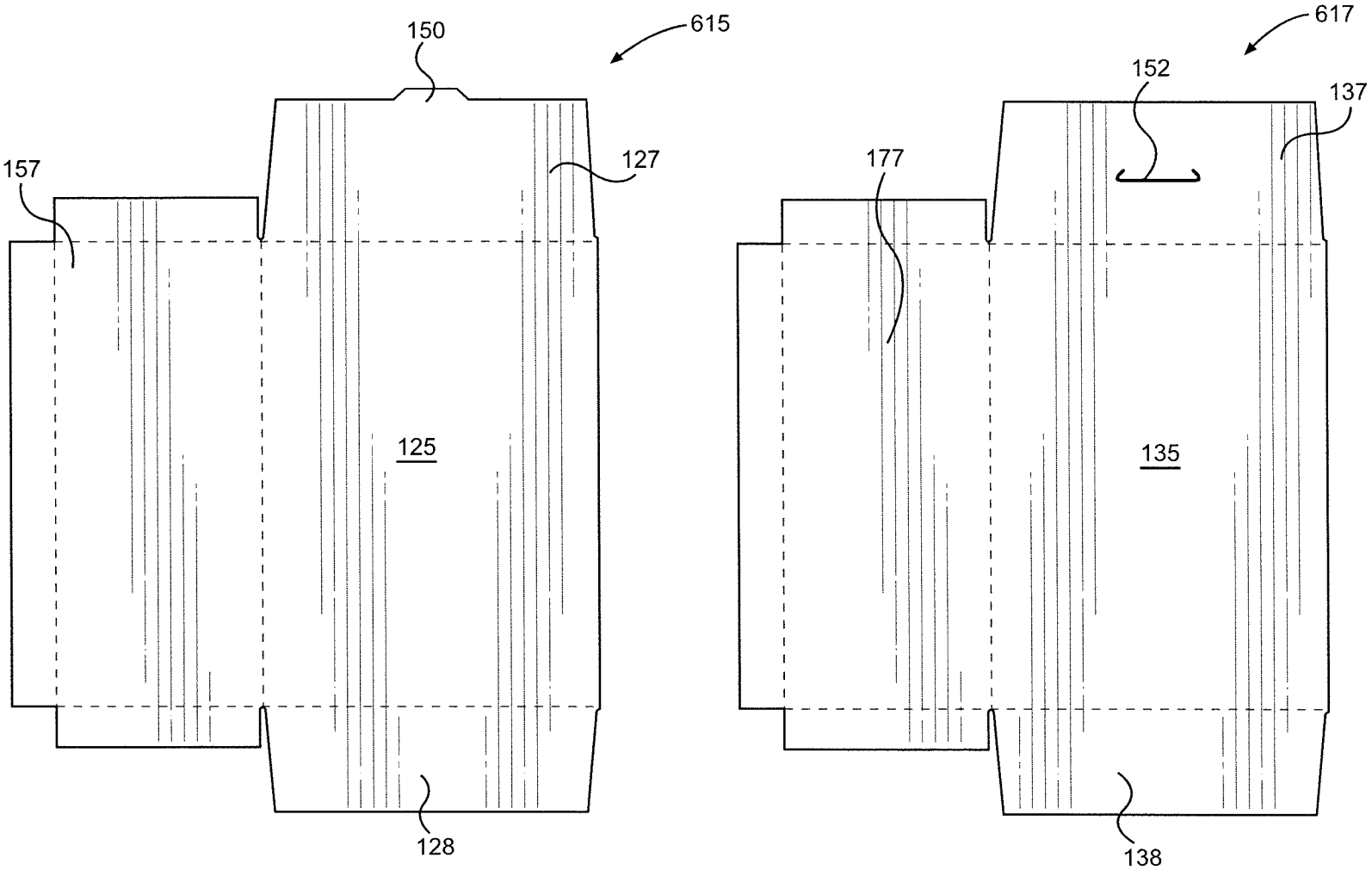
FIG. 11 is a plan view of a variant of the paperboard blank assembly of FIG. 9.
Figure 12:
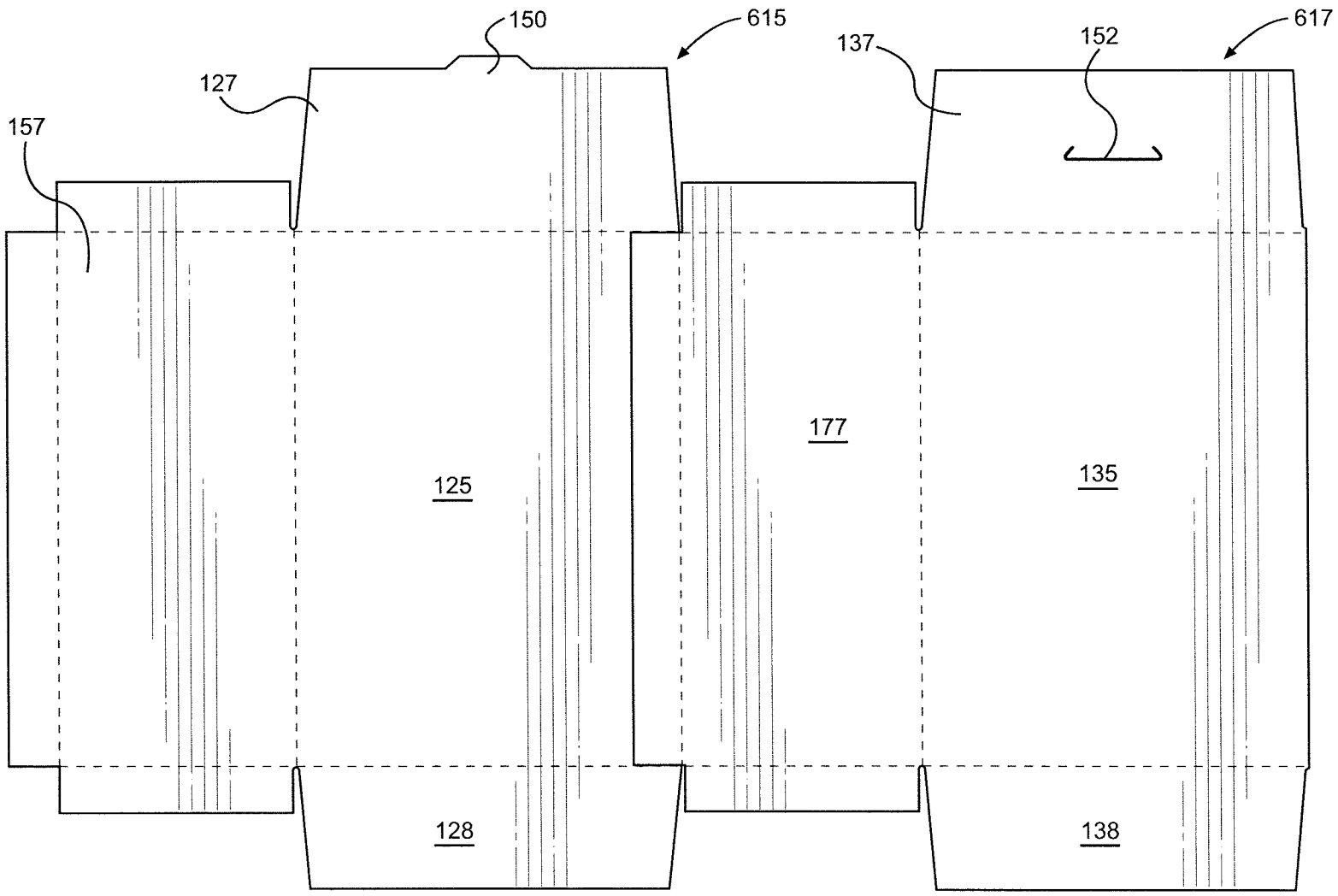
FIG. 12 is a plan view illustrating the blank assembly of FIG. 11 partially interconnected.

FIGS. 11 and 12 show a still further variation wherein a carton is made from just two body pieces 615 and 617. This embodiment is really a variation of the FIG. 5 embodiment with side wall 157 being made integral with main side wall 125, while side wall 177 is made integral with main side wall 135. Still, in a manner corresponding to the embodiment of FIGS. 9 and 10, body pieces 615 and 617 will vary in predominate fiber orientation, preferably also in caliper, and potentially also in material. Regardless of the different variations presented, based on the above, it should be readily apparent that the invention provides for an end load carton with enhanced compression strength even with a reduction in basis weight. In any case, although disclosed with reference to preferred embodiments of the invention, is should be readily apparent that various changes and modifications can be made to the invention without departing from the spirit thereof. For instance, assembly can be achieved utilizing other known bonding arrangements other than adhesive, such as ultrasonic welding. Finally, the cartons can be employed to house various products, including additional food products like noodles.

The invention claimed is:

1. A carton comprising an even number of body pieces which are folded and interconnected to establish at least a bottom wall, first and second spaced main face walls, opposing side walls and a top wall, which collectively define an interior cavity for containing an edible product to be sold to a consumer, with the first and second main face walls, as well as the opposing side walls, being spaced by each of the bottom wall and the top wall, each of said body pieces being formed of paperboard, wherein at least two of the body pieces have predominate fiber orientations which are directionally distinct from one another and the carton exhibits a compression strength which enables similarly configured cartons to be directly stacked upon each other for shipping purposes while resting on their respective bottom walls, wherein the predominate fiber orientations include at least one of the first and second main face walls having a first predominate fiber orientation which extends directionally between the opposing side walls while each of the opposing side walls includes a second predominate fiber orientation which extends directionally between the top and bottom walls, wherein each of the bottom and top walls is smaller in area than any one of the opposing side walls or first or second spaced main face walls, and each of the first and second spaced main face walls is larger in area than any one of the bottom, top or opposing side walls.

2. The carton of claim 1, wherein each of the first and second main face walls has the first predominate fiber orientation which extends directionally between the opposing side walls.

3. The carton of claim 2, wherein a caliper of at least one of the body pieces differs from a caliper of another of the body pieces.

4. The carton of claim 2, wherein the opposing side walls are made from a different grade of paperboard than the main face walls.

5. The carton of claim 1, wherein the body pieces are constituted by only first, second, third and fourth body pieces, with the first body piece establishing the first main face wall, the second body piece establishing the second main face wall, the third body piece establishing a first one of the opposing side walls and the fourth body piece establishing a second one of the opposing side walls, wherein the predominate fiber orientation of the first and second body pieces are directionally the same but different from the predominate fiber orientation of each of the third and fourth body pieces.

6. The carton of claim 5, wherein the predominate fiber orientations of the third and fourth body pieces are directionally the same.

7. The carton of claim 6, wherein each of the first and second main face walls has the first predominate fiber orientation which extends directionally between the opposing side walls.

8. The carton of claim 7, wherein a caliper of at least one of the body pieces differs from a caliper of another of the body pieces.

9. The carton of claim 8, wherein each of the opposing side walls has a caliper which is greater than a caliper of either of the first and second face walls.

10. The carton of claim 1, wherein the carton constitutes a cereal carton.

11. The carton of claim 1, wherein each opposing side wall is only a single layer of paperboard.

12. The carton of claim 1, wherein the first and second spaced main face walls are defined by separate ones of the even number of body pieces.

13. A plurality of cartons which are stacked in an exposed array on a pallet for shipping purposes, wherein at least one of the plurality of cartons is the carton of claim 1.

14. The plurality of cartons of claim 13, wherein said plurality of cartons are wrapped together to form a unit for shipping purposes.

15. A method of packaging edible food products comprising:

erecting a carton from an even number of body pieces which are folded and interconnected to establish at least a bottom wall, first and second spaced main face walls, opposing side walls and a top wall, which collectively define an interior cavity for containing the edible products, with the first and second main face walls, as well as the opposing side walls, being spaced by each of the bottom wall and the top wall, each of said body pieces being formed of paperboard, and at least one of the first and second main face walls has a predominate fiber orientation which extends directionally between the opposing side walls while each of the opposing side walls includes a predominate fiber orientation which extends directionally between the top and bottom walls, wherein each of the bottom and top walls is smaller in area than any one of the opposing side walls or first or second spaced main face walls, and each of the first and second spaced main face walls is larger in area than any one of the bottom, top or opposing side walls; and directly stacking a plurality of similarly constructed ones of the cartons upon each other, while resting on their respective bottom walls, for shipping purposes.

16. The method of claim 15, further comprising: stacking the plurality of cartons in an exposed array on a pallet for shipping purposes.

17. The method of claim 16, further comprising: wrapping the plurality of cartons together for shipping purposes.

* * * * *